US006959556B2

(12) United States Patent
Inoue et al.

(10) Patent No.: US 6,959,556 B2
(45) **Date of Patent: *Nov. 1, 2005**

(54) STIRLING REFRIGERATION SYSTEM

(75) Inventors: Takashi Inoue, Ohta (JP); Kazuhiko Mihara, Gunma (JP); Yasuo Sakamoto, Oizumi-Machi (JP); Masataka Hatta, Nirasaki (JP)

(73) Assignees: Sanyo Electric Co., Ltd., Osaka (JP); Tokyo Electron Limited, Tokyo (JP)

( * ) Notice: Subject to any disclaimer, the term of this patent is extended or adjusted under 35 U.S.C. 154(b) by 6 days.

This patent is subject to a terminal disclaimer.

(21) Appl. No.: 10/638,320

(22) Filed: Aug. 12, 2003

(65) Prior Publication Data

US 2004/0025519 A1 Feb. 12, 2004

(30) Foreign Application Priority Data

Aug. 12, 2002 (JP) ..... 2002-234874

(51) Int. Cl.[7] ..... F25B 9/00
(52) U.S. Cl. ..... 62/6
(58) Field of Search ..... 62/6

(56) References Cited

U.S. PATENT DOCUMENTS 2,797,068 A * 6/1957 McFarlan ..... 165/207
3,210,957 A * 10/1965 Walling et al. ..... 62/255
3,591,946 A * 7/1971 Loe ..... 96/175
4,419,864 A * 12/1983 McFarlan ..... 62/98
5,440,894 A * 8/1995 Schaeffer et al. ..... 62/203
5,927,079 A * 7/1999 Sekiya et al. ..... 62/6
6,021,846 A * 2/2000 Sasaki et al. ..... 165/144
RE37,040 E * 2/2001 Hughes et al. ..... 62/288
6,378,313 B2 * 4/2002 Barrash ..... 62/6
6,397,938 B1 * 6/2002 Nishishita ..... 165/153
6,481,216 B2 * 11/2002 Simmons et al. ..... 62/6

FOREIGN PATENT DOCUMENTS

JP 2000-18750 1/2000

* cited by examiner

*Primary Examiner*—William C. Doerrler
(74) *Attorney, Agent, or Firm*—Westerman, Hattori, Daniels & Adrian, LLP

(57) ABSTRACT

A Stirling refrigeration system (1) comprises two Stirling refrigeration units (4*a*, 4*b*) incorporating respective working gas end (WGE) heat exchangers (35*a*, 35*b*) and radiators (65*a*, 65*b*). Cooling water circulates through a first radiator (65*a*), a first WGE heat exchanger (35*a*), a second radiator (65*a*), a second WGE heat exchanger (35*a*), and a cooling-water pump (67) in sequence. To facilitate deaeration of the cooling-water circuit at time of feeding cooling water, An air release duct (85) is provided at the maximal point of the cooling-water circuit. An air release valve (79) is formed in the open end of the air release duct (85) so that the air remaining in the cooling-water circuit can be easily released. The Stirling refrigeration system is compact in dimensions.

11 Claims, 12 Drawing Sheets

STIRLING REFRIGERATION SYSTEM

FIELD OF THE INVENTION

The invention relates to a Stirling refrigeration system utilizing Stirling refrigeration units for use with a refrigeration apparatus.

BACKGROUND OF THE INVENTION

A Stirling refrigeration unit has been known as a compact refrigeration unit operable at fairly low temperatures with a high performance coefficient and a high refrigeration efficiency. In addition, it has an advantage that it is operable with an environmentally friendly Freon substitute.

For this reason, a Stirling cooling unit has been considered as a versatile refrigeration unit for use in, for example, refrigerators, freezers, throw-in type air conditioners for business and domestic use, and low-temperature fluid circulation systems, constant low-temperature boxes, thermostatic ovens, heat-shock test equipments, freeze-drying machines, temperature-characteristics test equipments, blood and cell preservation apparatuses, coolers, and various kinds of measuring apparatuses.

FIG. 1 is a schematic circuit diagram of a Stirling refrigeration system 100. As shown in FIG. 1, the Stirling refrigeration system 100 comprises Stirling refrigeration unit 110, a water-cooling unit 120, and a heat transport unit 130. Cold-refrigerant is provided to a refrigeration apparatus 101.

In the example shown in FIG. 1, in order to attain high refrigeration performance, the Stirling refrigeration system 100 is provided with two Stirling refrigeration units 110 connected in series, along with two water-cooling units 120.

Each of the Stirling refrigeration units 110 comprises a compression unit 114, an expansion unit 118, and a heat accumulation unit 119, as shown in FIG. 2. The compression unit 114 has a compression cylinder 112 and a compression piston 111 for compressing a working gas contained in the compression space 113 defined by the compression cylinder 112 and the piston 111. The working gas is compressed by the piston 111. The expansion unit 118 allows the working gas in an expansion space 117 defined by an expansion piston 115 and an expansion cylinder 116 to expand as the expansion piston 115 reciprocates in the expansion cylinder 116. A heat accumulation unit 119 is provided in a gas passage S communicating with the compression space 113 and the expansion space 117.

A motor 109 is provided to drive a crank mechanism 108 for converting the rotational motion of the motor 109 to reciprocal motions of the compression piston 111 and the expansion piston 115, thereby compressing and expanding the working gas.

The compressed working gas passes through the gas passage S to the heat accumulation unit 119, where the gas is cooled, and then to the expansion space 117 where the gas expands to lower its temperature.

A cold head 131 provided in the header of the expansion unit 118 is cooled by the cold gas. Thus, a secondary refrigerant circulating through the cold head 131 is cooled.

After expanded in the expansion unit 118, the working gas returns to the compression unit 114 through the heat accumulation unit 119, completing the Stirling cycle.

It is noted that the compression piston 111 leads the expansion piston 115 in phase by about 90 degrees.

The heat transport unit 130 shown in FIG. 1 has a secondary refrigerant pump 132, a tank 133, a liquid-gas separator 134, and a pressure regulation bellows 135. The secondary refrigerant pump 132 pressurizes the secondary refrigerant, causing the secondary refrigerant to circulate through a secondary refrigerant circuit connecting the cold head 131 with the refrigeration apparatus 101. The tank 133 adjusts the flow of the secondary refrigerant that circulates through the secondary refrigerant circuit. The liquid-gas separator 134 receives the secondary refrigerant returning from the refrigeration apparatus 101 and separates the liquid component and the gaseous component of the refrigerant (the separation will be referred to gas-liquid separation). The pressure regulation bellows 135 absorbs pressure fluctuations occurring in the secondary refrigerant circuit.

The liquid-gas separator 134 has a gas-liquid separation tube 136 and a gas recovery tube 137. The gas-liquid separation tube 136 has a shape of a generally inverted U-shape and is connected to a tube for returning the secondary refrigerant from the refrigeration apparatus 101. The gas recovery tube 137 has one end connected to a top section of the gas-liquid separation tube 136, and another end connected to the upper end of the tank 133 to communicate with the free space of the tank 133.

The gas-liquid separation is performed in the gas-liquid separation tube 136 by causing only the gaseous component of the refrigerant to flow upward in the tube 136 when the secondary refrigerant flow upward in the gas-liquid separation tube 136 after it has returned from the refrigeration apparatus 101. The gaseous secondary refrigerant separated in the gas-liquid separation process is stored in the tank 133 via the gas recovery tube 137.

It will be understood that the secondary refrigerant undergoes a volumetric change due to a change in temperature as it refrigerates the refrigeration apparatus 101.

Since the heat transport unit 130 is a closed cycle, the pressure in the secondary refrigerant circuit will change if the secondary refrigerant changes its volume. The pressure regulation bellows 135 alleviates this pressure change.

Thus, the pressure regulation bellows 135 is adapted to increase its length as the pressure in the secondary refrigerant circuit increases, and decreases its length as the pressure decreases. Accordingly, the pressure inside the secondary refrigerant circuit is maintained at a substantially constant pressure.

It should be noted that the temperature of the working gas rises as it is compressed in the compression unit 114 and that the efficiency of cooling the working gas would undesirably decline if the hot working gas were directly led to the heat accumulation unit 119 before it is led to the expansion unit 118.

Hence, in order to circumvent this adverse effect, the working gas is cooled by the water-cooling unit 120 provided in the gas passage S between the compression unit 114 and the heat accumulation unit 119.

The water-cooling unit 120 includes a heat exchanger (not shown)for cooling the working gas (referred to as working gas end (WGE) heat exchanger), a radiator 121, and a cooling-water pump 122. The WGE heat exchanger effects heat exchange between the working gas and the cooling water. The radiator 121 effects heat exchange between the cooling water and the atmosphere. The cooling-water pump 122 circulates the cooling water through the WGE heat exchanger and the radiator 121.

The radiator 121 has a main body which includes a continuous fluid tube 125 having a multiplicity of parallel sections 123 and curved sections 124 connecting the parallel sections, and a plurality of fins 126 fitted on the parallel sections 123.

Fins 126 effect heat transfer between the cooling water flowing inside the fluid tube 125 and the atmosphere.

In this way the working gas is cooled by liberating its thermal energy from fins 126 to the atmosphere to enhance refrigeration efficiency.

As described above, this Stirling refrigeration system 100 has two Stirling refrigeration units 110 and two water-cooling units 120, to enhance its refrigeration power. For this reason, Stirling refrigeration system 100 described above also requires two cooling-water pumps 122. This arrangement, however, has a disadvantage that Stirling refrigeration system becomes large in dimensions and hence requires a large installation area.

Further, deaeration of the cooling-water circuit is difficult, though it is necessary when filling cooling water to the water-cooling unit 120. This can happen because the water-cooling unit 120 includes many vertical tubes and curved sections (convex sections) connecting the vertical tubes, which can easily trap air. Hence, a considerable amount of air remains in the tubes.

If the air continues to remain in the tubes, the cooling-water pump 122 will fail pumping the refrigerant, only "biting" the air (the failure of pumping referred to as "air-biting"), which can damage the shaft of the pump 122 and cause a loud noise.

Furthermore, since the fluid tube 125 of the radiator 121 has many parallel section 123 and curved sections 124, if the parallel sections 123 are inclined during the installation of the radiator 121, air will remain inside the parallel sections 123, which will degrade the heat radiation efficiency of the water-cooling radiator 121.

SUMMARY OF THE INVENTION

In accordance with one aspect of the invention, there is provided a Stirling refrigeration system of the invention, comprising at least two Stirling refrigeration units, each having:

a compression unit for compressing a working gas;

an expansion unit for expanding said working gas compressed by said compression unit to lower the temperature of said working gas to cool a cold head;

a water-cooling unit for cooling said working gas that has risen in temperature in said compression with cooling water, said water-cooling unit adapted to exchange heat with the atmosphere in a radiator; and a WGE heat exchanger for effecting heat exchange between said compressed working gas and said cooling water for cooling said working gas, wherein said working gas is circulated between said compression unit and said expansion unit to cool a secondary refrigerant, and said WGE heat exchanger and said radiator (heat exchanger-radiator assembly) of a respective Stirling refrigeration unit are connected to a cooling-water circuit such that said cooling water circulates said heat exchange-radiator assemblies in turn. This system is compact in dimensions and has improved refrigeration efficiency.

In accordance with another aspect of the invention, the Stirling refrigeration system is adapted to circulate cooling water through said cooling-water circuit directly connected to all of said WGE heat exchangers and all of said radiators by a single cooling-water pump, to thereby implement a compact yet efficient system capable of efficient refrigeration.

In accordance with a still another aspect of the invention, the cooling-water circuit has at a high level section an air release duct for releasing the air trapped in the cooling-water circuit and an air release valve at the external end of the air release duct to facilitate easy and positive deaeration of the trapped air, thereby preventing air-biting of the cooling-water pump and suppressing the noise due to the air-biting and at the same time improving the reliability of the system.

In accordance with a further aspect of the invention, the radiator is provided with a multiplicity of radiator panels in parallel arrangement with their adjacent faces facing each other, each panel having a multiplicity of straight vertical fluid pipes, said fluid pipes connected at the upper and lower ends thereof to an upper header and a lower header for communication with each other through said headers;

an inlet tube and an outlet tube connected to said upper and lower headers, respectively; and a plurality of fins fitted on each of said fluid pipes. This arrangement advantageously prevents the trapped air from remaining in the radiators, and thus prevents reduction of the heat transfer coefficient caused by the remaining air.

In accordance with a further aspect of the invention, the cooling-water circuit has at a high level section thereof a cooling-water feeding tube having an open end for feeding cooling water into said cooling-water circuit, said cooling-water feeding tube connected to said cooling-water circuit with said open end positioned at a level higher than said cooling-water circuit, and a cooling-water inlet valve provided at said open end of said cooling-water feeding tube. This arrangement allows the cooling water fed in said cooling-water feeding tube to run down through it by gravity.

In accordance with a further aspect of the invention, at least a portion of each air extraction tube is made of a transparent or translucent tube for convenience of monitoring the amount of air accumulating in the air release duct during operation.

DETAILED DESCRIPTION OF THE PREFERRED EMBODIMENT

Figure 4:
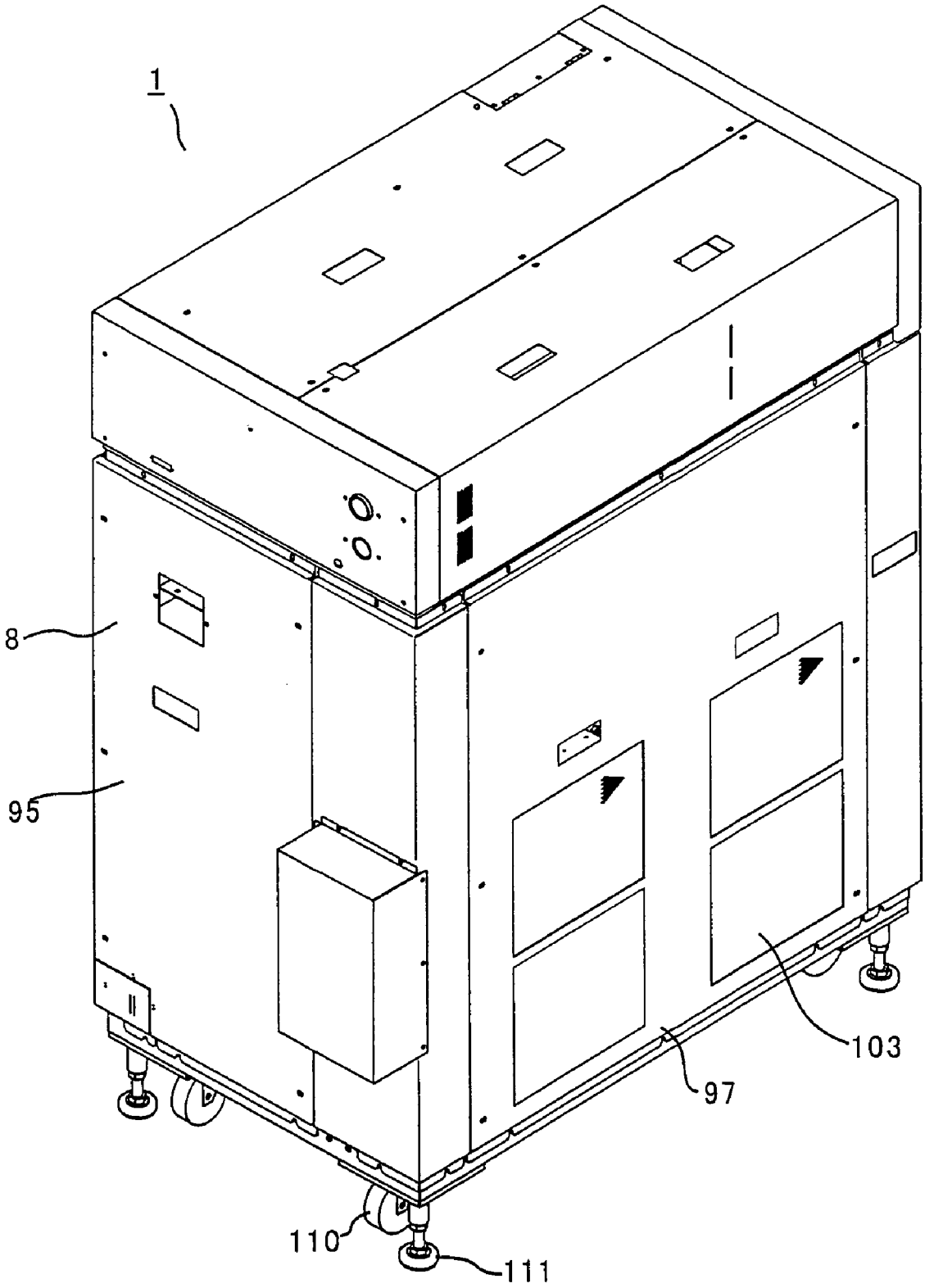
FIG. 4 shows a perspective view of a Stirling refrigeration system in accordance with an embodiment of the invention.
Figure 5:
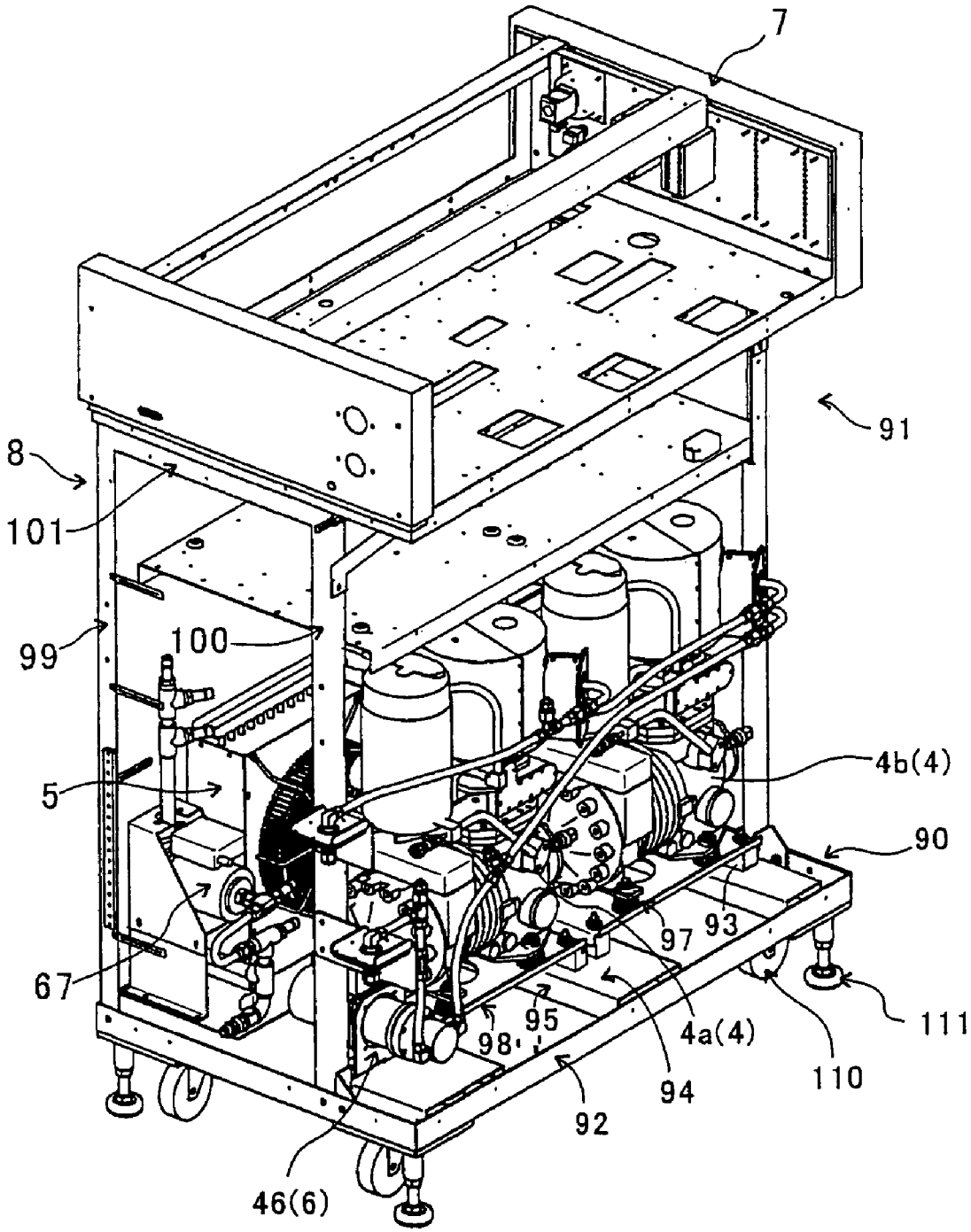
FIG. 5 shows a perspective view of a Stirling refrigeration system with its side panels removed in accordance with the invention.
Figure 6:
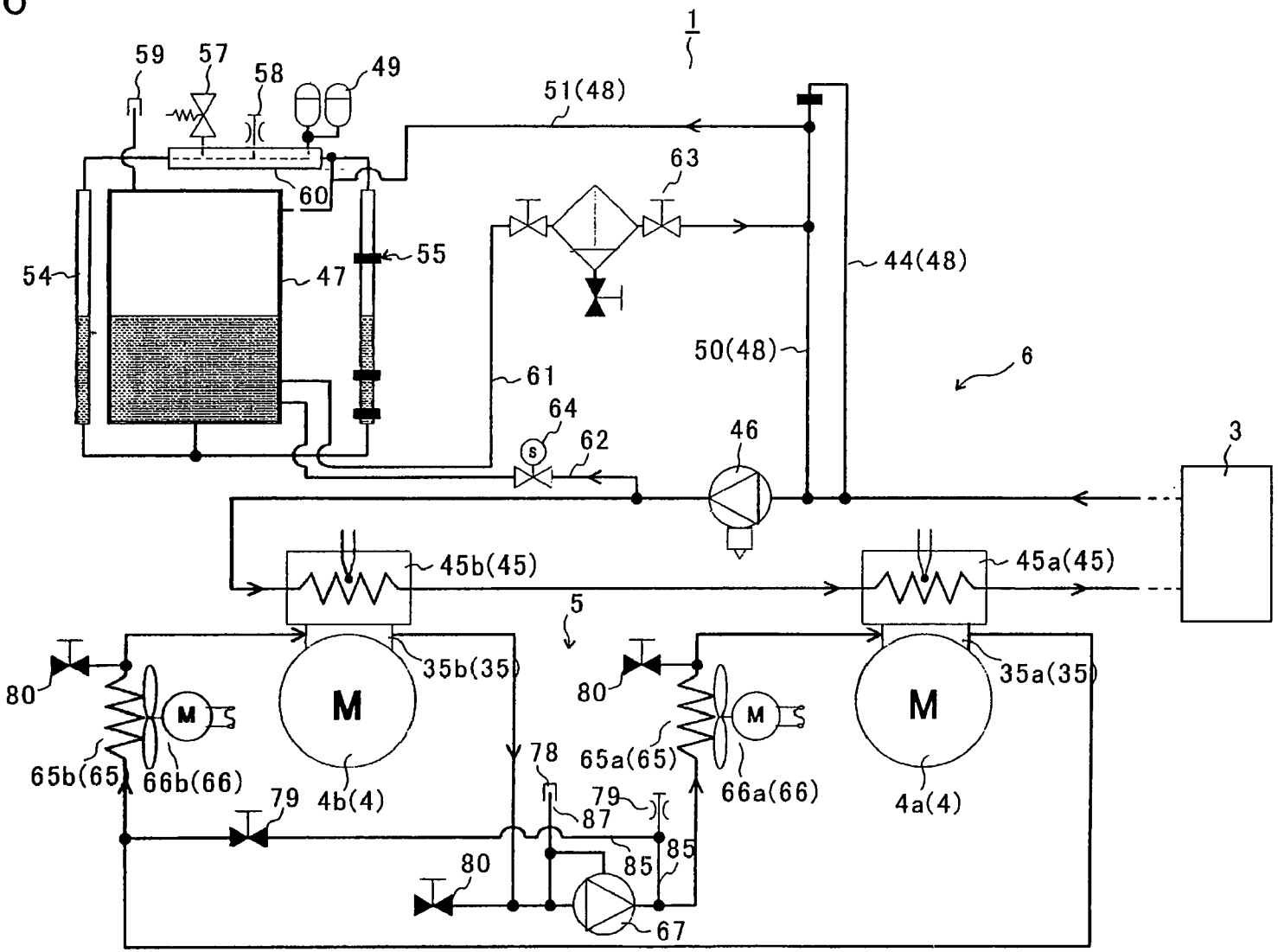
FIG. 6 is a circuit diagram of the Stirling refrigeration system shown in FIG. 5.

Preferred embodiments of the invention will now be described with reference to the accompanying drawings. Referring to FIG. 4, there is shown in a perspective view a Stirling refrigeration system 1 in accordance with one embodiment of the invention, FIG. 5 is a perspective view of the elements of the system 1 inside a housing. FIG. 6 is a circuit diagram of the Stirling refrigeration system 1.

The Stirling refrigeration system 1 comprises such major elements as two Stirling refrigeration units 4, 4, a water-cooling unit 5, a heat transport device 6, a control device (not shown), and a chassis 8 for accommodating these elements. Each of the Stirling refrigeration units 4 can generate cold refrigerant. The water-cooling unit 5 can effects heat exchange with a working gas and cooling water of the Stirling refrigeration unit 4 to liberate heat into the atmosphere. The heat transport device 6 serves to supply cold refrigerant generated in the Stirling refrigeration unit 4 to a secondary refrigerant (e.g., hydro-fluoro-ether, HFE) which circulated between the Stirling refrigeration unit 4 and an external apparatus 3 utilizing the cold refrigerant. A control device (not shown) can control the Stirling refrigeration system 1 so as to provide a necessary amount of cold refrigerant in response to a demand of the refrigeration apparatus 3. A chassis 8 accommodates each of these elements described above.

FIG. 5 omits details of the controller and shows only the case 7 of the controller.

Generally, a Stirling refrigeration unit is operated in intermittent mode to maintaining a constant output power, meeting a demand of the load connected to its cold refrigerant.

Figure 1:
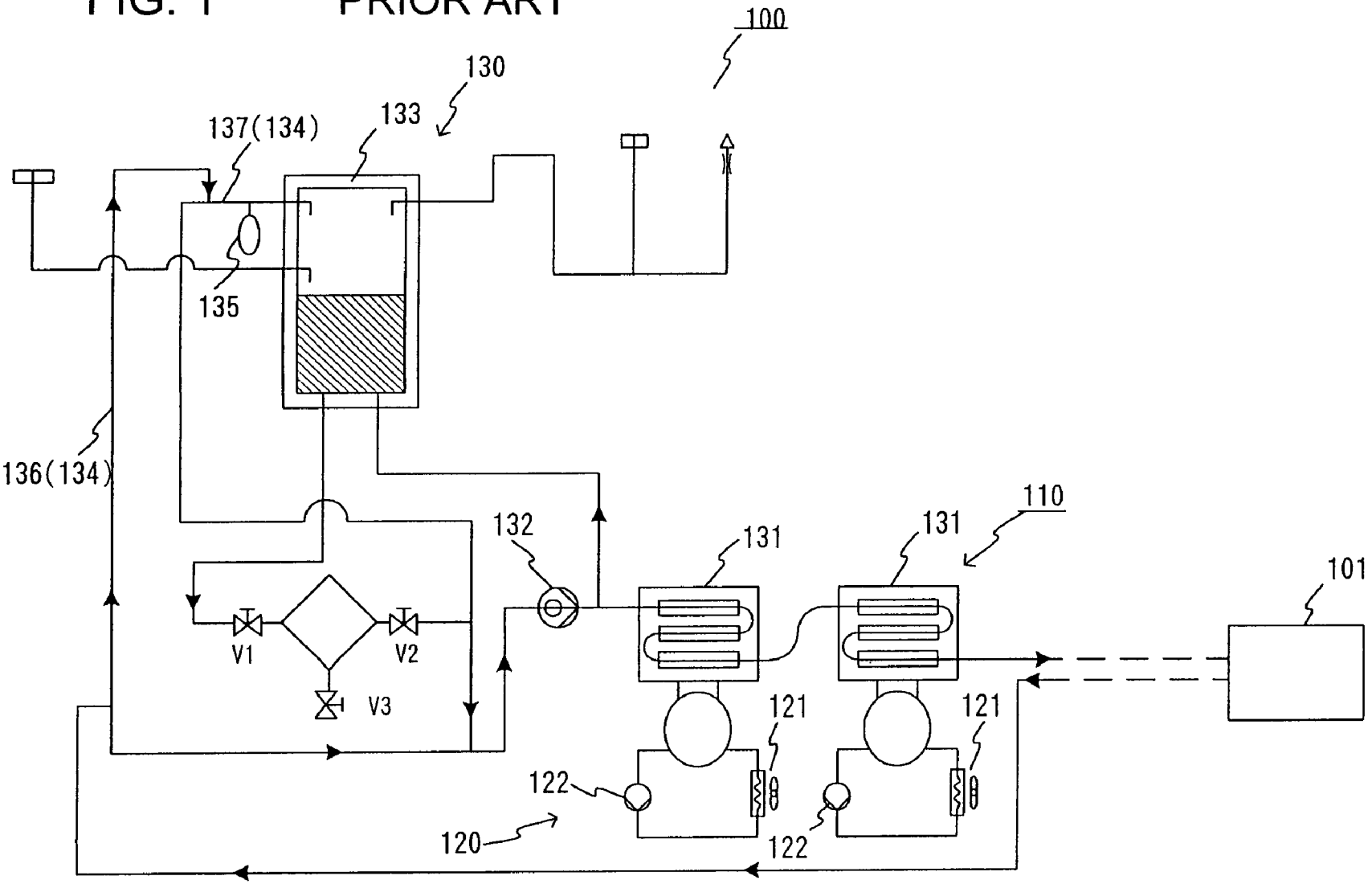
FIG. 1 PRIOR ART
FIG. 1 is a circuit diagram of a conventional Stirling refrigeration system.
Figure 2:
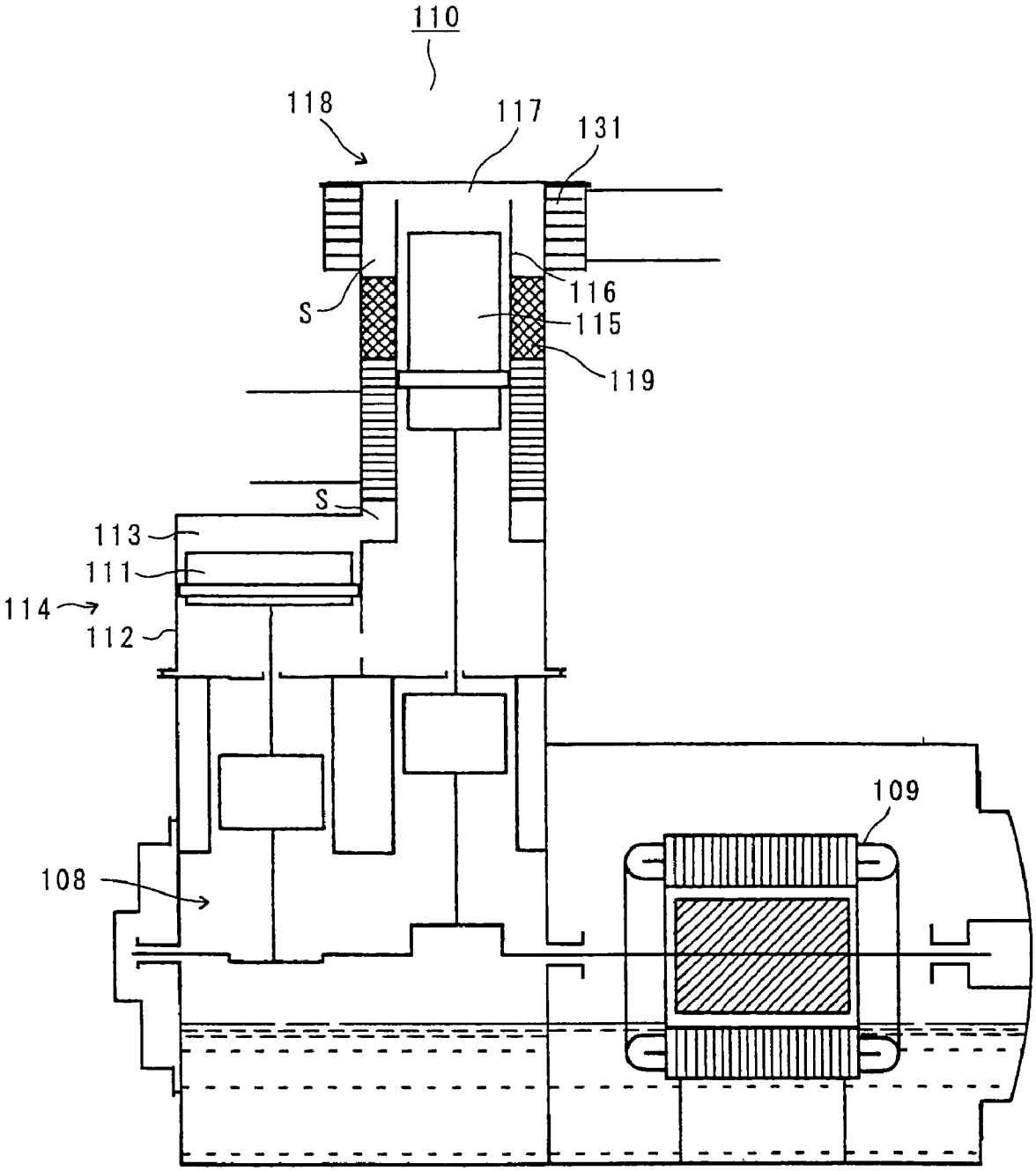
FIG. 2 PRIOR ART
FIG. 2 is a schematic diagram showing a structure of a conventional Stirling refrigeration unit.

For this reason, a Stirling refrigeration system as shown in FIG. 1 must be large-scaled in order to meet a sudden demand of a refrigeration apparatus utilizing the refrigeration.

However, large scale Stirling refrigeration units are expensive, and their running cost is high since they are operated at a constant refrigeration power even under intermittent operational mode.

As a consequence, the unit wastefully generates a superfluous amount of cold refrigerant under a reduced load, resulting in a poor economical efficiency of the unit.

As an alternative, one might think of using a multiplicity of small scale Stirling refrigeration units to provide a required amount of cold refrigerant. In this case, the multiple Stirling refrigeration units may be connected in series (series configuration) or in parallel (parallel configuration) to the secondary refrigerant.

In the parallel configuration, the flow of secondary refrigerant can be increased since the secondary refrigerant is divided to the respective Stirling refrigeration units. However, the rate of cooling (temperature drop) of the secondary refrigerant is substantially the same as that of a single Stirling refrigeration unit.

The parallel configuration has a further disadvantage in that all the Stirling refrigeration units must be operated (i.e. stopped and resumed) simultaneously in an intermittent mode to efficiently control the amount of cold refrigerant to be supplied.

However, simultaneous operation of the multiple Stirling units will result in a large refrigeration power that intervals of intermittent operations will be shortened, which will in turn increase the load on the control elements used (more frequent on-off operations of power switches, for example), requiring more reliable and expensive control elements.

On the other hand, in the series configuration, it is possible to increase the temperature drop of the secondary refrigerant, since the secondary refrigerant circulates through the multiple Stirling refrigeration units in turn, though it is difficult to increase the total flow of the secondary refrigerant in circulation.

Further, in the series configuration, Stirling refrigeration units can be individually operated to control the refrigeration power of the composite unit that a long interval is permitted between two intermittent operations, which advantageously permits use of cost-effective elements.

From this point of view, the inventive refrigeration unit utilizes at least two Stirling refrigeration units 4 connected in series.

In what follows, when it is necessary to distinguish two or more than two Stirling refrigeration units, they are referred to as a first Stirling refrigeration unit 4*a*, second Stirling refrigeration unit 4*b*, etc., but otherwise they are individually or collectively referred to as Stirling refrigeration unit(s) 4.

Figure 7:
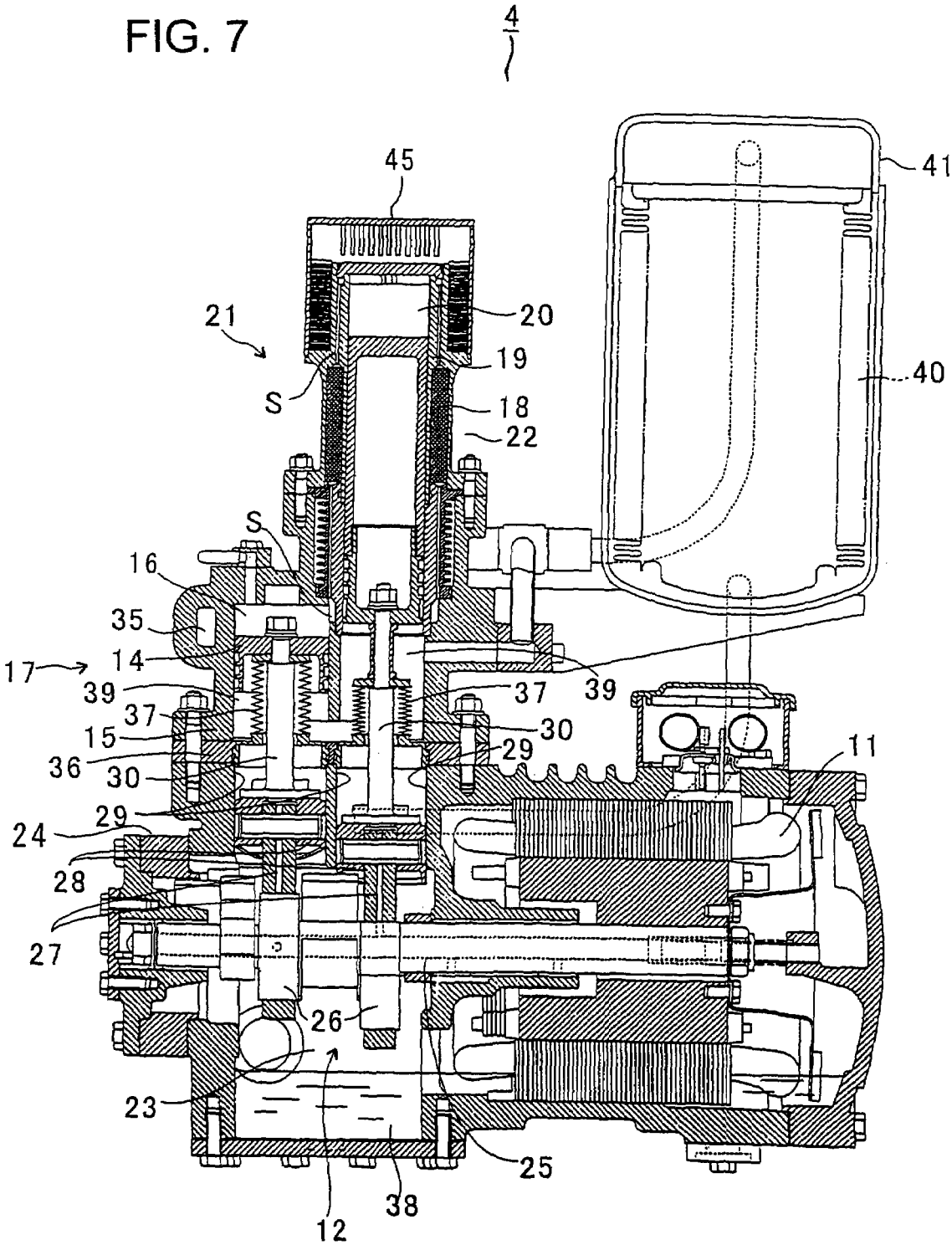
FIG. 7 is a cross sectional view showing a structure of the Stirling refrigeration unit in accordance with the invention.

As shown in FIG. 7, each of the Stirling refrigeration units 4 has a crank section 12, a compression unit 17, an expansion unit 21, and a heat accumulation unit 22. The crank section 12 converts the rotational motion of a motor 11 into reciprocal motions of pistons. The compression unit 17 can compress the working gas in the compression space 16 formed between a compression piston 14 and a compression cylinder 15 by reciprocating the compression piston 14. The expansion unit 21 allows the working gas to expand in the expansion space 20 defined by an expansion piston 18 and an expansion cylinder 19 when the expansion piston 18 recedes in the expansion cylinder 19. The heat accumulation unit 22 consists of a metal mesh sheet provided in a gas passage S for communicating the compression space 16 with the expansion space 20.

The crank section 12 of the Stirling refrigeration unit 4 is housed in a crank housing 24 which serves as a crankcase 23. The crank section 12 includes such elements as a crank 26 connected with the shaft 25 of the motor 11, a connecting rod 27 having one end connected to the crank 26, a crossing guide head 28 connected to the other end of the connecting rod 27, and a cross guide liner 29 for limiting the motion of the crossing guide head 28 in one direction.

In this arrangement, the rotational motion of the motor 11 is converted into the reciprocal motions of the compression piston 14 and the expansion piston 18 by the crank section 12.

In the example shown herein, the compression piston 14 leads in phase the expansion piston 18 by about 90 degrees.

The compression piston 14 and the expansion piston 18 are connected to the respective crossing guide heads 28 via respective piston rods 30. Oil seal bellows 37 are provided, each having one end fixed on the respective piston rods 30 and the other end fixed on a fixed plate 36.

These oil seal bellows 37 are made of a metal, adapted to expand and contract in accordance with the reciprocal motions of the respective piston rods 30, and are adapted to hermetically separate the spaces formed on the side of the compression piston 14 and the expansion piston 18 from the spaces on the side of the crossing guide heads 28.

Thus, the oil seal bellows 37 prevents lubrication oil 38 provided for lubrication of the crossing guide heads 28 and adhering to the compression piston 14 and the expansion piston 18 from entering the compression space 16 and the expansion space 20, thereby preventing a loss of refrigeration efficiency that would be otherwise caused by the infiltration of the lubricant into the spaces.

The spaces (hereinafter referred to as "back pressure rooms") 39 defined by the oil seal bellows 37 and the compression piston 14 and the expansion piston 18 are sealed air-tight by the oil seal bellows 37.

As a consequence, when the compression piston 14 and the expansion piston 18 reciprocate, the atmosphere in the back pressure rooms 39 are compressed and expanded, consuming the energy of the motor. This load on the motor lowers the refrigeration efficiency.

Hence, in the Stirling refrigeration unit 4 in accordance with an embodiment of the invention, a buffer tank 41 is provided, communicating with the back pressure rooms 39 and the crankcase 23 via a bellows 40.

In the embodiment shown herein, each of the Stirling refrigeration units 4 is provided with a WGE heat exchanger 35 formed to surround the compression space 16 or to surround the gas passage S communicating the compression space 16 with the heat accumulation unit 22. The WGE heat exchanger 35 is cooled by cooling water that circulates through it.

In the Stirling refrigeration unit 4 shown, the working gas is compressed in the compression space 16 when the compression piston 14 moves from its lower dead point to its upper dead point. Meanwhile, the expansion piston 18 ascends to the upper dead point and then descends.

The working gas, compressed in the upward motion of the compression piston 14, flows into the expansion unit 21 through the gas passage S. In the downward motion of the expansion piston 18, the working gas is passed to the expansion space 20 through the heat accumulation unit 22.

Heat is transferred from the working gas to the heat accumulation unit 22 as the working gas passes through the heat accumulation unit 22. The heat is accumulated in the heat accumulation unit 22. As the expansion piston 18 reaches its lower dead point, the compression piston 14 moves from its upper dead point to its lower dead point, allowing the working gas to expand.

Since this process amounts to an isothermal expansion of the working gas, it is endoergic, causing the working gas to absorb heat from a cold-head 45 on top of the expansion space 20, thereby cooling the cold head 45.

Since a secondary refrigerant is in circulation in contact with the cold head 45 as will be described later, the secondary refrigerant is cooled by the cold head 45.

As the compression piston 14 approaches its lower dead point, the expansion piston 18 begins its upward motion, allowing the working gas to return to the compression space 16 through the gas passage S, where the working gas undergoes heat exchange with the heat accumulation unit 22.

The above-described processes together constitute 1 cycle of the Stirling refrigeration unit 4 in accordance with the invention. The cold head 45 can be used as a cold heat source by the refrigeration apparatus 3.

The cold head 45 described above serves as an heat exchanger of the heat transport unit 6, for cooling the secondary refrigerant. Hence, the cold head 45 will be hereinafter referred to as cold head end (CHE) heat exchanger 45.

The heat transport device 6 is further has a secondary refrigerant pump 46, a tank 47, a liquid-gas separator 48, and a pressure regulation bellows 49. The secondary refrigerant pump 46 causes the secondary refrigerant to circulate through the refrigeration apparatus 3. The tank 47 regulates the flow of the secondary refrigerant in circulation. The liquid-gas separator 48 is adapted to separate the gas component from the secondary refrigerant that has returned from the apparatus 3, thereby returning only the liquid refrigerant to the secondary refrigerant pump 46. The pressure regulation bellows 49 is adapted to absorb pressure change occurring in the secondary refrigerant circuit caused by the expansion of the secondary refrigerant cooling the refrigeration apparatus 3.

The secondary refrigerant circulates through a second CHE heat exchanger 45*b*, a first CHE heat exchanger 45*a*, the refrigeration apparatus 3, and the secondary refrigerant pump 46.

The liquid-gas separator 48 is adapted to separate the liquid-gas mixture of the secondary refrigerant returning from refrigeration apparatus 3 into liquid and gas components, and is composed of a gas-liquid separation tube 44, a fluid return tube 50 for returning the liquid component of the secondary refrigerant to the secondary refrigerant circuit, and a gas recovery tube 51 for leading the gaseous component of the secondary refrigerant to the tank 47.

The gas-liquid separation tube 44 is provided in a pipe 52 between the refrigeration apparatus 3 and the secondary refrigerant pump 46. The upper ends of the gas-liquid separation tube 44 and the liquid return tube 50 are connected to each other, forming a generally inverted U-shape tube. The gas recovery tube 51 is connected to the liquid return tube 50 near the top of the inverted U-shape tube.

When the liquid-gas mixture of the secondary refrigerant returns to the secondary refrigerant pump 46 after the circulation, gas component of the secondary refrigerant rises in the liquid-gas separation tube 44. Thus, gas-liquid separation of the secondary refrigerant is attained in the tube 44. The gas component is recovered in the tank 47 via the gas recovery tube 51.

As a result of the gas-liquid separation, only the liquid secondary refrigerant returns to the secondary refrigerant pump 46, thereby preventing adverse air-biting in the secondary refrigerant pump 46.

Having passed the liquid-gas separator 48, the gaseous secondary refrigerant is collected in the tank 47 via the gas recovery tube 51, as described above. The gaseous refrigerant is liquefied and stored in the tank 47 when the temperature inside the tank 47 becomes lower than the condensation temperature of the refrigerant.

Of course, the gaseous secondary refrigerant can be condensed and liquefied while it is flowing upward in the liquid-gas separator 48. In addition, a minute amount of the liquid secondary refrigerant can be transported upward by the ascending flow of the gaseous secondary refrigerant in the liquid-gas separator 48. The liquefied component and ascending liquid secondary refrigerant carried by the gaseous refrigerant will seep in the liquid-gas separator 48 or in the liquid return tube 50, and eventually return to the secondary refrigerant circuit.

The tank 47 is provided with a level meter 54 for visual indication of the amount of the secondary refrigerant currently stored in the tank 47, and with a multiplicity of level sensors 55 for detecting the amount of the secondary refrigerant in the tank 47.

The upper space of the tank 47 communicates with the pressure regulation bellows 49, a safety valve 57, a tank vent 58, and a secondary refrigerant inlet valve 59.

The pressure regulation bellows 49 is adapted to regulate the pressure in the secondary refrigerant circuit across the gas recovery tube 51 and the gas-liquid separation tube 44 by changing the length of the bellows 49. The safety valve 57 is adapted to open when the pressure in the tank 47 exceeds a predetermined level, thereby preventing the pressure in the tank 47 from reaching a hazardous level.

The tank vent 58 is used to forcibly relieve the pressure of the tank 47. The secondary refrigerant inlet valve 59 is used to supply the secondary refrigerant.

Figure 8:
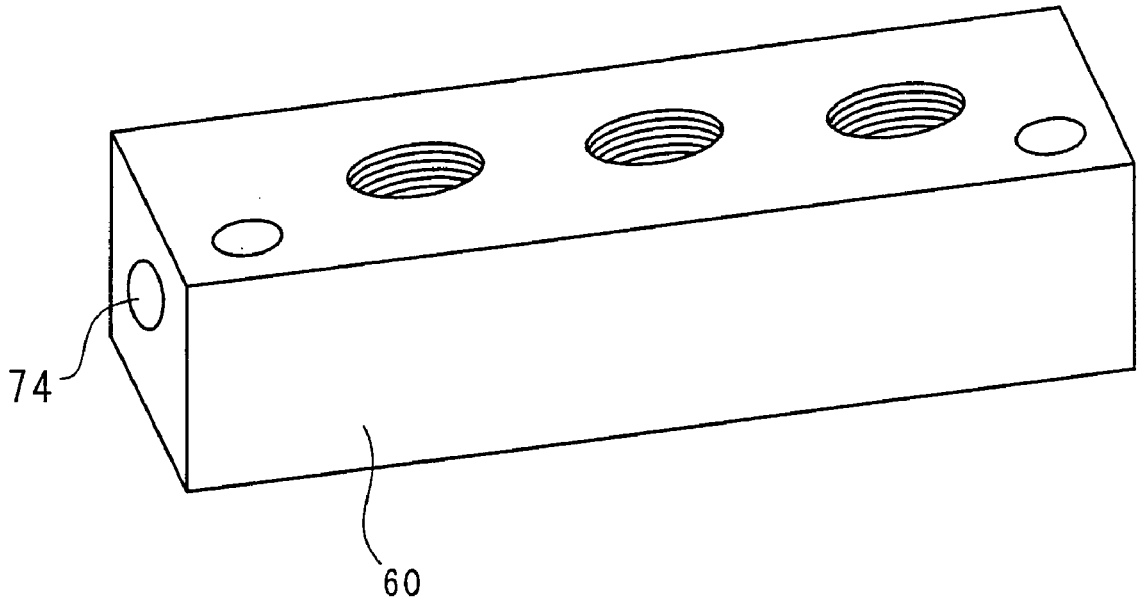
FIG. 8 is a perspective view of an embodiment of square block in accordance with the invention.
Figure 9:
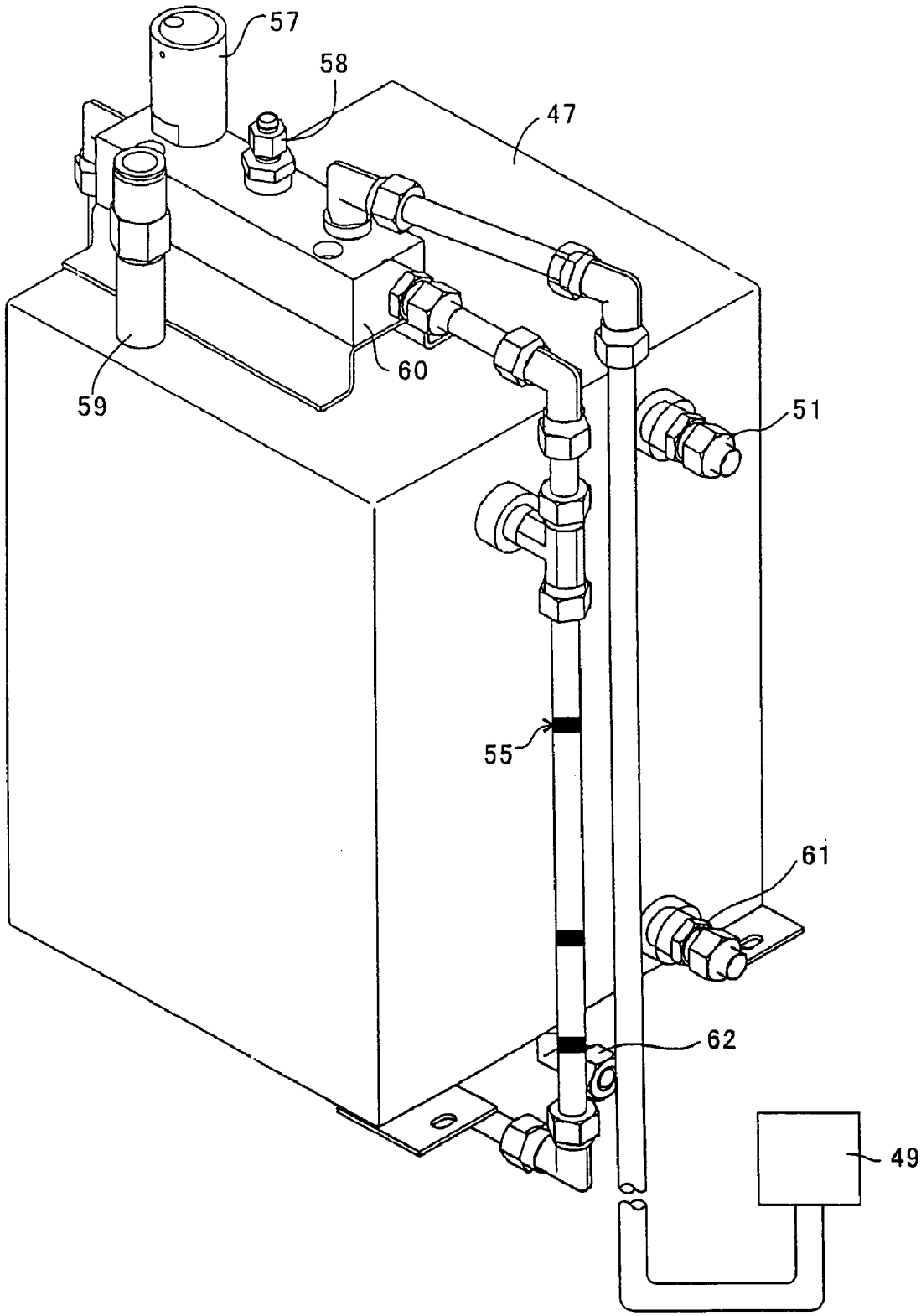
FIG. 9 is a perspective view the square block mounted on a tank.

The pressure regulation bellows 49, safety valve 57, tank vent 58, and secondary refrigerant inlet valve 59 are mounted on a square metal block 60 which is in turn mounted on top of the tank 47. The square block can be any general-purpose block. The square block 60 has a through-hole 77 as shown in FIGS. 8 and 9.

It could happen that the amount of the secondary refrigerant in circulation in the secondary refrigerant circuit becomes deficient due to, for example, recovery of an excessive amount of gaseous secondary refrigerant into the tank 47 or leakage of the refrigerant, or conversely that the amount in circulation becomes excessive for some reason.

As a remedial measure for such problems, the tank 47 is provided in the bottom thereof with a tube (referred to as refrigerant replenishment tube) 61 for use in replenishing the refrigerant and a liquid recovery tube 62.

The refrigerant replenishment tube 61 is connected to the liquid return tube 50 via a refrigerant inlet valve 63. The secondary refrigerant circuit can be replenished by opening the liquid replenishing valve 63.

The liquid recovery tube 62 is connected to a tube between the secondary refrigerant pump 46 and the second Stirling refrigeration unit 4. The tube has a liquid recovery valve 64.

Thus, in this arrangement, should an excessive amount of the secondary refrigerant be in circulation in the secondary refrigerant circuit, the liquid recovery valve 64 is opened to lead the excessive secondary refrigerant fed from the secondary refrigerant pump 46 to the tank 47, thereby regulating the total amount of the refrigerant in circulation.

As described previously, the pressure regulation bellows 49 can absorb pressure fluctuations in the secondary refrigerant circuit arising from cooling of the refrigeration apparatus 3, by extending or contracting its length in accordance with the pressure in the secondary refrigerant circuit. The pressure regulation bellows 49 would lose this capability, however, if liquid secondary refrigerant entered the bellows 49.

However, in conventional Stirling refrigeration unit (FIG. 1), liquid refrigerant could enter the pressure regulation bellows 135 since the pressure regulation bellows 135 is formed within the gas recovery tube 137.

In order to prevent such adverse effect, the gas recovery tube 137 is in principle designed to allow only gas second refrigerant to flow through it.

In the Stirling refrigeration system 100, if a large pressure loss is created (due to for example an excessive amount of the secondary refrigerant being in circulation) between the node (connection) of the liquid-gas separation tube 136 and the node of the liquid return tube, both connected between the refrigeration apparatus 101 and the secondary refrigerant pump 132, a liquid-gas mixture of the second refrigerant can enter the gas-liquid separation tube 134, which can then cause liquid secondary refrigerant to flow into the tank 133 via the gas recovery tube 137.

Under such condition, if the pressure regulation bellows 135 is provided in the gas recovery tube 137 as in the conventional arrangement shown in FIG. 1, liquid secondary refrigerant is likely to adversely flow into the pressure regulation bellows 135 as it flows into the tank 133 via the gas recovery tube 137.

This problem has been conventionally circumvented by forming the node of the liquid-gas separator 48 in proximity to the node of the liquid return tube 50 so as not to create a large pressure loss between them, and by carefully choosing the positions of the nodes and the method of connecting the liquid-gas separator 48 and liquid return tube.

However, if the tubes are connected at the desired positions by a desired method to clear all these problems mentioned above, then piping of the refrigerant circuit often becomes too complicated. Moreover, it would be difficult to secure a sufficient room for maintenance or miniaturize the Stirling refrigeration system 1.

Therefore, in the present invention, the pressure regulation bellows 49 is mounted on the square block 60 which has an opening communicating with the upper space of the tank 47 so that liquid secondary refrigerant will not enter the pressure regulation bellows 49 if it enters the tank 47 via the gas recovery tube 51.

Further, the gas recovery tube 51 is inclined in such a way that it connects to the tank 47 at a position higher than the position of its node with the liquid return tube 50. Consequently, the liquid secondary refrigerant entering the gas recovery tube 51 will be prevented from flowing into the tank 47 by the inclination.

Thus, in this arrangement, it is not necessary to take account of the pressure loss between the nodes of the gas-liquid separation tube 44 and of the liquid return tube 50, and hence the positions of the nodes and the manner in which the tubes are connected are irrelevant. This permits a large degree of design freedom of a compact Stirling refrigeration system 1 and ease of maintenance of such system.

This freedom also permits use of a general-purpose T-shape pipe for example for establishing the node of the liquid-gas separator 48 and for the node of the liquid return tube 50, which is helpful to cut down the cost of the refrigeration system.

The temperature of the working gas rises when it is compressed in the Stirling refrigeration unit 4. If the hot working gas is sent to the expansion unit 21 via the heat accumulation unit 22, refrigeration efficiency will fall. To circumvent this adverse effect, the water-cooling unit 5 is provided to liberate heat from the working gas to the atmosphere before the gas is delivered to the expansion unit 21.

The water-cooling unit 5 comprises a radiator 65, a fan 66, and a cooling-water pump 67, in addition to the WGE heat exchanger 35. The WGE heat exchanger 35 has a cooling water channel that surrounds the gas passage S between the compression space 16 and the heat accumulation unit 22 of the Stirling refrigeration unit 4 to effect heat exchange between the working gas and the cooling water. The radiator 65 effects heat exchange between the atmosphere and the cooling water which has undergone heat exchange in the WGE heat exchanger 35. In this sense the radiator 65 may be referred to as atmosphere-end (AE) heat exchanger. The fan 66 feeds air to the radiator 65 to enhance heat exchange between the cooling water and the atmosphere. The cooling-water pump 67 causes the cooling water to circulate through the WGE heat exchanger 35 and the radiators 65.

The embodiment shown herein is provided with two WGE heat exchangers 35, two radiators 65, two fans 66, and only one cooling-water pump 67.

As already stated, when two Stirling refrigeration units 4, 4 need to be distinguished in this specification, they are referred to as the first and the second Stirling refrigeration units 4*a* and 4*b*, respectively. Similarly, each of the WGE heat exchangers 35 will be refereed to as the first and the second WGE heat exchanger 35*a* and 35*b*, respectively; the radiators 65, the first and the second radiators 65*a* and 65*b*, respectively; and the fans 66, the first and the second fans 66*a* and 66*b*, respectively.

Thus, the cooling water channel includes a loop of the cooling-water pump 67, first radiator 65*a*, first WGE heat exchanger 35*a*, second radiator 65*b*, and second WGE heat exchanger 35*b* all connected in series, so that the refrigerant alternately flows through the radiator 65 and the WGE heat exchanger 35 of the respective units in turn.

Two radiators 65 are provided one for each of the two Stirling refrigeration units 4, for the reason discussed below.

As described previously, the secondary refrigerant is first cooled by the second Stirling refrigeration unit 4*b* and then further cooled by the first Stirling refrigeration unit 4*a* before it is supplied to the refrigeration apparatus 3.

As a consequence, the first Stirling refrigeration unit 4*a* operates in a temperature domain closer to the target temperature of the Stirling refrigeration unit 4 than the second Stirling refrigeration unit 4*b*.

For this reason, it is possible in principle to utilize only one radiator 65 while circulating the refrigerant first through the first WGE heat exchanger 35*a* and then through the second WGE heat exchanger 35*b* to provide necessary refrigeration.

To do so, however, the radiator 65 must have a larger refrigeration capacity or must be of a new type having an improved heat radiation efficiency. In any event, such radiator will be costly.

Therefore, in the embodiment shown herein, two conventional fin-type compact radiators are used to provide sufficient heat radiation, one for each of the Stirling refrigeration units 4 while suppressing the cost.

It is also possible to provide two cooling-water pumps 67 in association with the radiators 65.

Use of two cooling-water pumps 67, however, requires a much larger installation area. Therefore, use of one cooling-water pump having a large pump capability will be advantageous. Besides, it is less costly.

Thus, in the embodiment shown herein, a single cooling-water pump 67 is used to implement a compact and cost effective Stirling refrigeration system 1.

Figure 10:
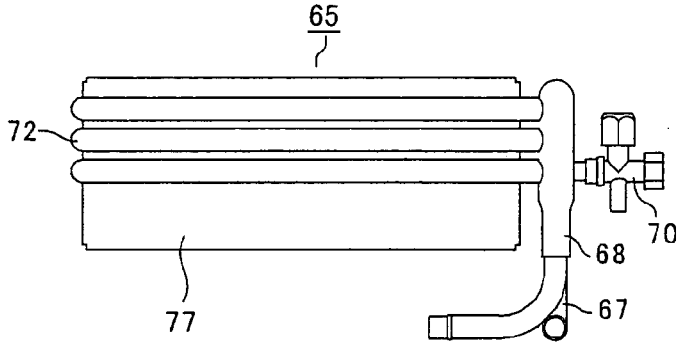
FIG. 10 shows a structure of a radiator in accordance with the invention.
Figure 10:
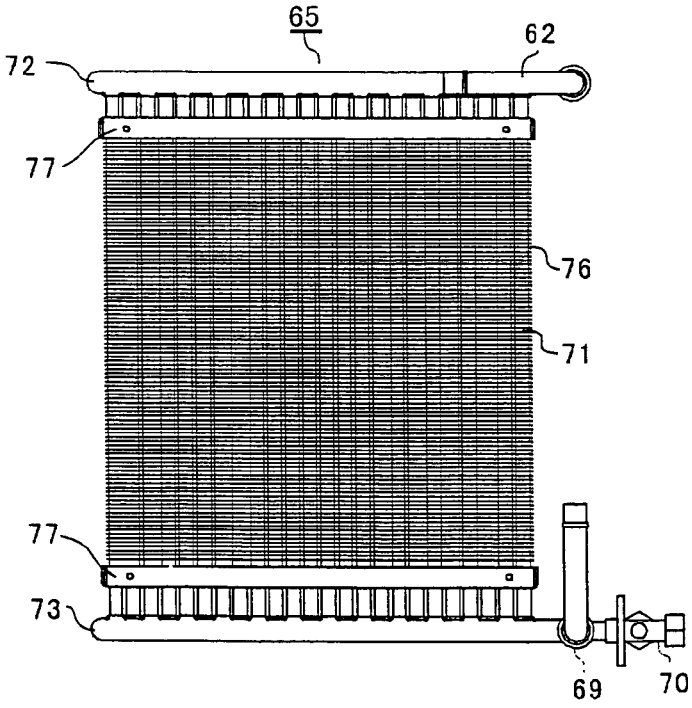
Figure 10:
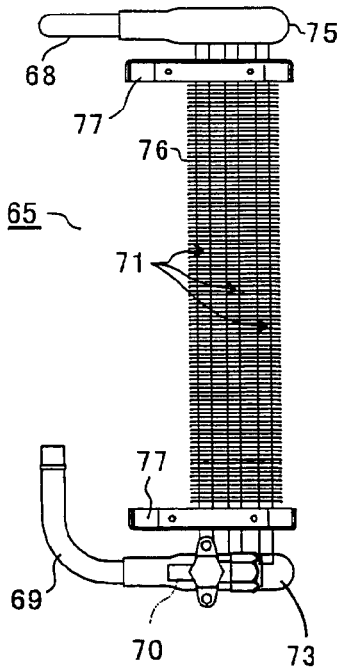
Figure 11:
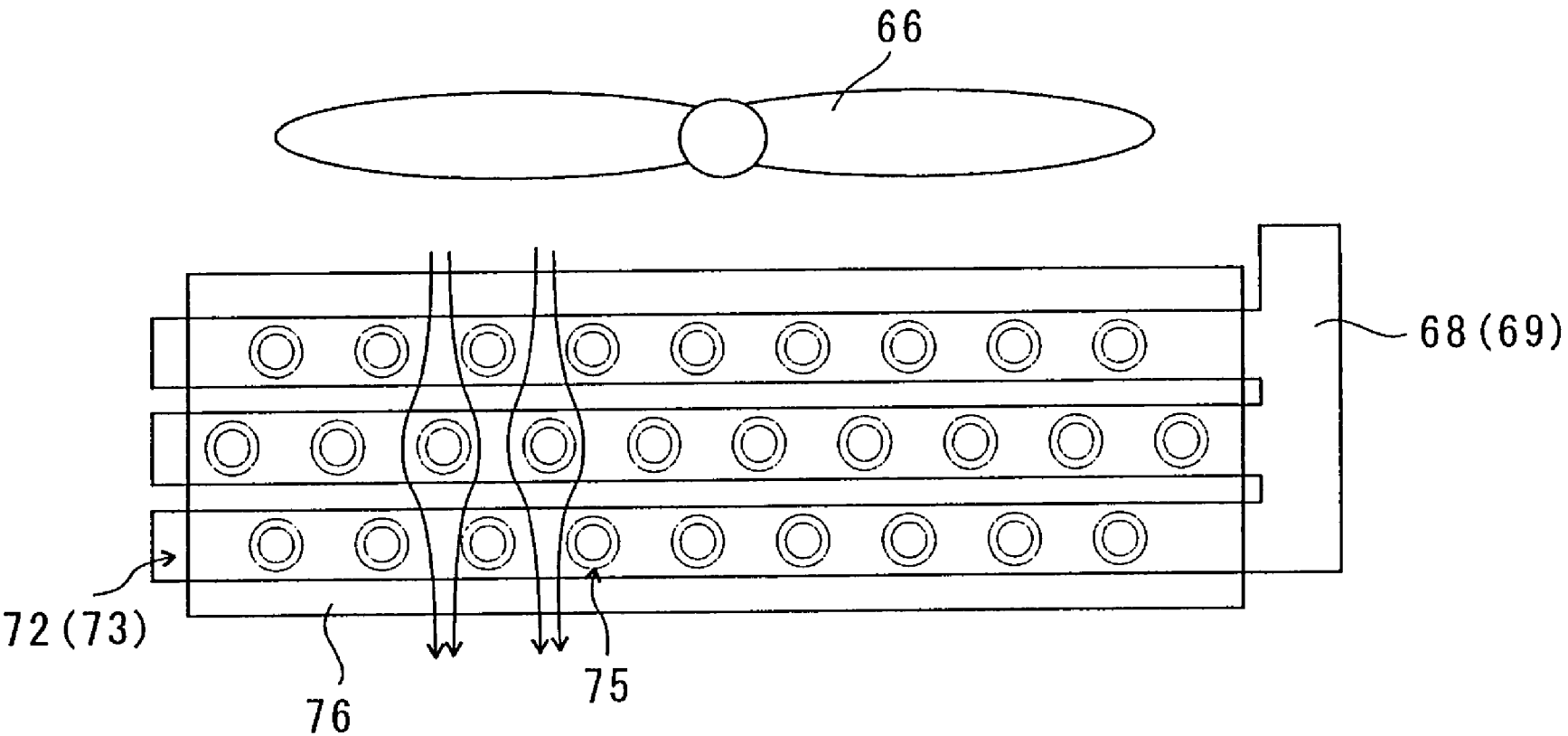
FIG. 11 shows an arrangement of fluid tubes of the radiator of the invention.

FIGS. 10(*a*)–(*c*) show a plan view, a front view, and a side view of a radiator 65, respectively The radiator 65 comprises an inlet tube 68 for feeding cooling-water through it, an outlet tube 69, a drain 70 connected to the outlet tube 69 for use in discharging the cooling water in the radiator 65, and three radiator panels 71 for effecting heat exchange between the cooling water and the atmosphere.

Each of the radiator panels 71 has an upper header 72, a lower header 73, a fluid tube 75, fins 76, and tube terminating plates 77. The upper header 72 and the lower header 73 are elongate members lying on the upper and lower ends of the radiator and connected to the inlet tube 68 and the outlet tube 69, respectively. The fluid tube 75 consists of a plurality of copper tubes connected between the upper header 72 and the lower header 73. Each of the fins 76 is an aluminum plate fitted on the respective fluid tubes 75 of the three radiator panels 71. The tube terminating plates 77 are securely connected to the fluid tubes 75 of the three radiator panels 71 for holding the three radiator panels 71 integral, and protects the respective fins 76.

The fluid tubes 75 of the respective radiator panels 71 are spaced apart at equal intervals such that the fluid tubes 75 of one radiator panel 71 are offset to those of another radiator panel 71.

This arrangement is employed to improve the heat exchange efficiency of the radiator, thanks to zigzag flow of air across the fluid tubes 75 of the respective radiator panels 71, removing heat from the radiator with a high heat transfer coefficient.

The fluid tubes 75 are securely fixed to the upper header 72 and the lower header 73 in a compact form, using either a thermal (e.g. soldering) or a non-thermal (e.g. pressure) bonding technique, thereby providing an enough work space to work with the radiator.

Although square tubes and circular tubes can be used equally well for the upper header 72 and the lower header 73, circular tubes are used in this embodiment for reasons as discussed below.

The circular tubes are chosen particularly when the fluid tubes 75 are soldered to the upper header 72 and the lower header 73, because they can withstand a larger thermal stress than square tubes, and are not liable to thermal deformation during soldering.

Square tubes can be used when the headers can be fixed by a method free of thermal stresses, e.g. pressing.

The cooling-water circuit includes a cooling-water inlet valve 78 for feeding cooling water to the circuit, a multiplicity of air release valves 79 for deaerating or releasing the air trapped in the cooling-water circuit when cooling water is supplied, and a multiplicity of drain valves 80 for draining the cooling water from the cooling-water circuit.

Figure 12:
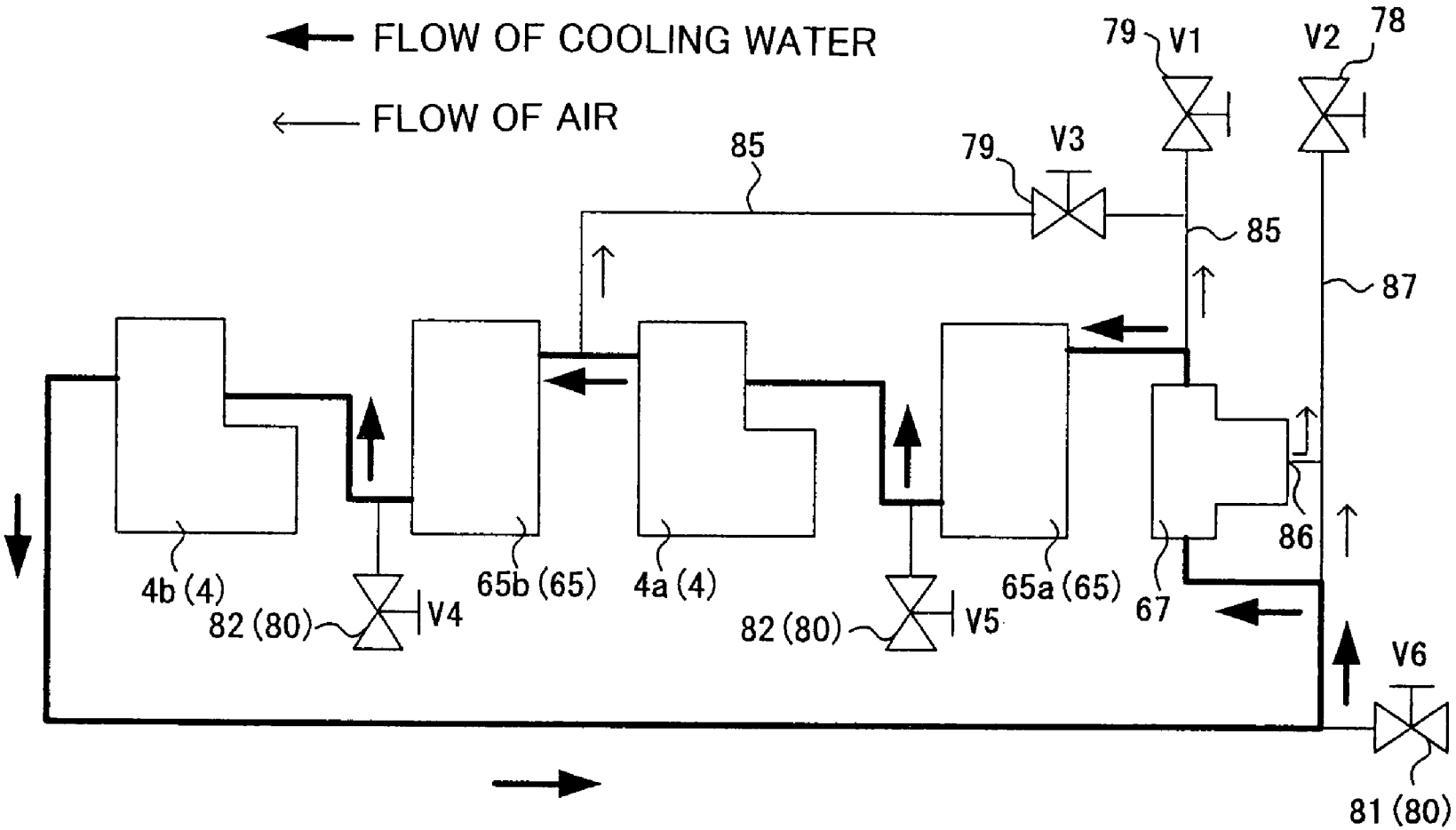
FIG. 12 is a block diagram of a cooling-water circuit in accordance with the invention.

The water-cooling unit 5 has a configuration as shown in FIG. 6. FIG. 12 schematically shows the water-cooling unit 5, with special emphasis on the levels of different tubes. As shown in FIG. 12, the inlets and outlets of the respective Stirling refrigeration units 4, the radiators 65, and the cooling-water pump 67 have different levels.

Because of the differences in level of the tubes, a multiplicity of air releasing valves 79 and drain valves 80 are provided, as will be described later.

One of the drain valves 80 is provided at the lowest level of the cooling-water circuit. This drain valve 80 will be hereinafter referred to as main drain valve 81.

Other drain valves 80 are mounted at the lowest point of U-shape sections of the tubes formed between, for example, Stirling refrigeration unit 4 and the radiator 65. These drain valves 80 will be referred to as sub-drain valves 82. The position of the tubes at which a respective sub-drain valve 82 is connected will be referred to as minimal point.

An air release valves 79 is provided in each of multiple air release ducts 85 which are respectively mounted at the uppermost positions of inverted U-shape tubes connected between, for example, Stirling refrigeration unit 4 and radiator 65. Such uppermost positions will be referred to as maximal points.

The cooling-water inlet valve 78 is mounted on the uppermost position of a cooling-water feeding tube 87 which communicates with the water feeding port 86 of the cooling-water pump 67 and the main drain valve 81. This uppermost point is the highest point of the cooling-water circuit.

To fill the cooling-water circuit with cooling water, both of the cooling-water inlet valve 78 and the air release valve 79 are opened, and cooling water is fed from the cooling-water inlet valve 78.

It is noted that conventional systems are not provided with such dedicated cooling water inlet valve 78 and that cooling water must be injected from the drain valve 80.

However, since drain valve 80 is provided at such low position of the cooling-water circuit, conventional systems have a disadvantage that pressurization means such as a pump is required to feed cooling water.

In contrast, in the inventive cooling-water system, cooling-water can be fed without adding any pressure to it, since the cooling-water inlet valve 78 is provided at the highest point of the cooling-water circuit so that the cooling water flows down into the cooling-water circuit by gravity.

When cooling water is fed in the cooling-water circuit, it is necessary to purge from the cooling-water circuit the air trapped therein. However, tubes of the cooling-water circuit are long and have many kinks and maximal and minimal points, as shown in FIG. 12, which tend to trap air.

Therefore, in the embodiment shown herein, air release ducts 85 are connected to the maximal points of the cooling-water circuit to release trapped air easily and substantially completely.

Figure 3:
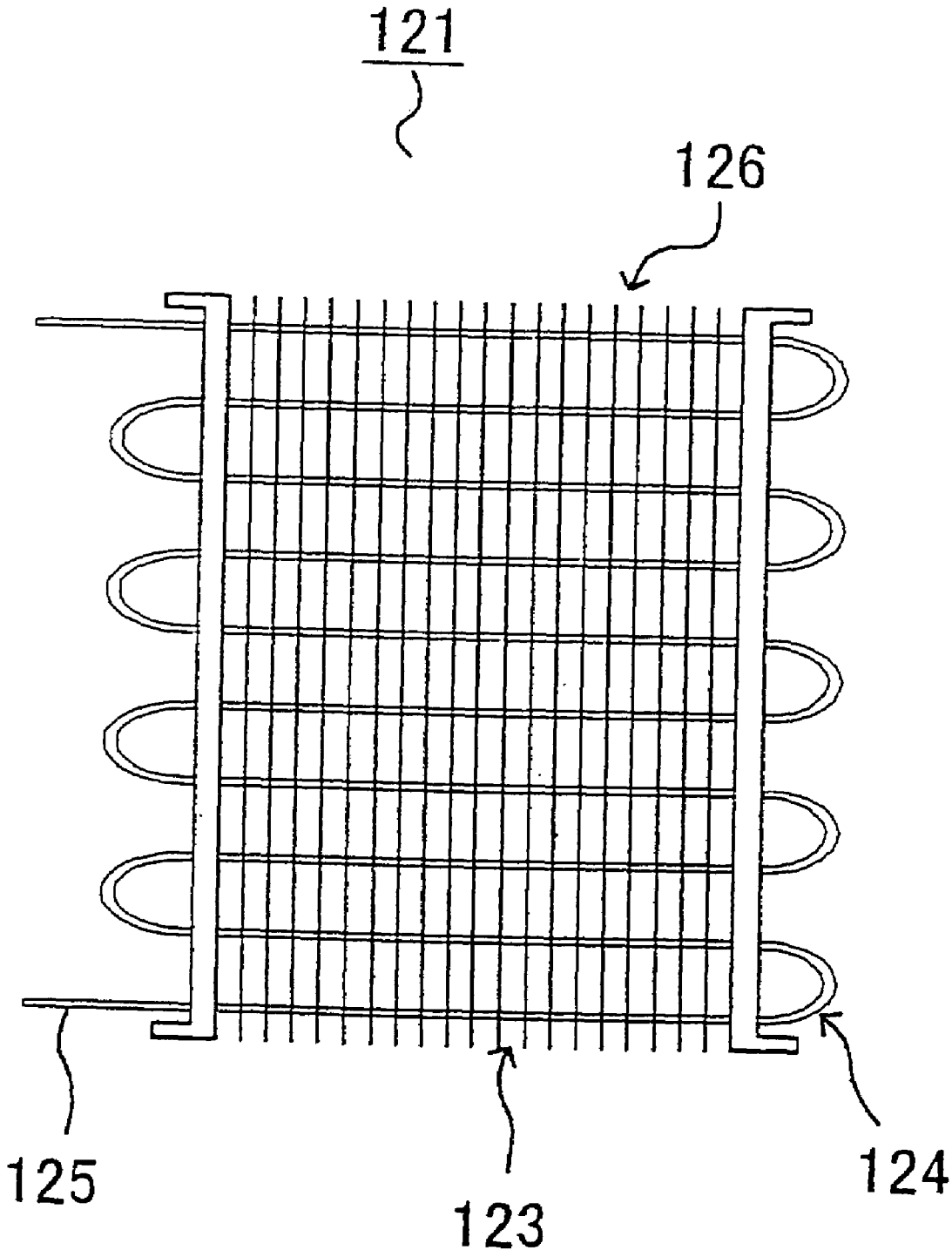
FIG. 3 PRIOR ART
FIG. 3 shows a schematic view of a conventional radiator.

Further, if the fluid tube 125 of the radiator 65 had many parallel sections 123 and curved section 124, zigzagging as shown in FIG. 3, air would remain in the parallel sections in the event that the parallel sections were inclined during the installation of the radiator, and cause problems as discussed below.

The fins 126 are fitted on the parallel sections 123, for heat transfer from the cooling water to the atmosphere.

Therefore, if air remains in the parallel sections, heat transfer efficiency of the 65 will be significantly reduced, so that refrigeration power of the refrigeration system will decline.

Therefore, in the embodiment shown herein, the fluid tube 75 is divided into a multiplicity of vertical sections, as shown in the FIG. 10. As a consequence, if air remains in the radiator, it will not remain in the fluid tube 75, thereby preventing the loss of heat transfer efficiency of the 65 and the loss of refrigeration efficiency.

Although it is preferable to purge air completely from the cooling-water circuit, a certain amount of air always remains in the circuit, because a trace of air adheres to the inner walls of the tube when cooling water is fed.

Such remaining air will migrate with the circulating cooling water and accumulates in, for example, the cooling-water pump 67, causing airbiting of the pump and generating anomalous noise.

In the embodiment shown herein, however, the cooling-water feeding tube 87 and air release ducts 85 are provided at higher levels than the maximal points and the cooling-water pump 67 and oriented upward. Hence, if remaining air should migrate with the cooling water, it would accumulate in the cooling water feeding tube 87 and air release duct 85 as the water passes through the maximal points and cooling-water pump 67.

Thus, air-biting of the cooling-water pump 67 or generation of anomalous noise can be prevented accordingly.

The remaining air can be easily released from the air release valve 79 before the air accumulates in the cooling-water feeding tube 87 and air release duct 85 by observing the amount of the remaining air through the air release duct 85 and the transparent cooling water feeding tube 87. The transparency of the tubes are also convenient to monitor leakage and/or deficiency of the cooling water.

What is claimed is:

1. A Stirling refrigeration system, comprising one cooling-water pump and at least two Stirling refrigeration units, each Stirling refrigeration unit having:

a compression unit for compressing a working gas;

an expansion unit for expanding said working gas compressed by said compression unit to lower the temperature of said working gas to cool a cold head;

a water-cooling unit for cooling said working gas that has risen in temperature in said compression unit with cooling water, said water-cooling unit adapted to exchange heat with the atmosphere in a radiator; and a WGE heat exchanger for effecting heat exchange between said compressed working gas and said cooling water for cooling said working gas, wherein said working gas is circulated between said compression unit and said expansion unit to cool a secondary refrigerant, said WGE heat exchanger and said radiator (heat exchanger-radiator assembly) of a respective Stirling refrigeration unit are connected to a cooling-water circuit such that said cooling water circulates said heat exchange-radiator assemblies in turn, and said one cooling water pump for circulating said cooling water through all of said WGE heat exchangers and all radiators connected in series in said cooling-water circuit.

2. The Stirling refrigeration system according to claim 1, further comprising:

a release duct connected to a high level section of said cooling-water circuit, for releasing air trapped in said cooling-water circuit; and an air release valve provided at the external end of said air release duct.

3. The Stirling refrigeration system according to claim 1, wherein said radiator is provided with:

a multiplicity of radiator panels in parallel arrangement with their adjacent faces facing each other, each panel having a multiplicity of straight vertical fluid pipes, said fluid pipes connected at the upper and lower ends thereof to an upper header and a lower header for communication with each other through said headers;

an inlet tube and an outlet tube connected to said upper and lower headers, respectively; and a plurality of fins fitted on each of said fluid pipes.

4. The Stirling refrigeration system according to claim 2, wherein said radiator is provided with:

a multiplicity of radiator panels in parallel arrangement with their adjacent faces facing each other, each panel having a multiplicity of straight vertical fluid pipes, said fluid pipes connected at the upper and lower ends thereof to an upper header and a lower header for communication with each other through said headers;

an inlet tube and an outlet tube connected to said upper and lower headers, respectively; and a plurality of fins fitted on each of said fluid pipes.

5. The Stirling refrigeration system according to claim 1, further comprising:

a cooling-water feeding tube having an open end for feeding cooling water into said cooling-water circuit, said cooling-water feeding tube connected to said cooling-water circuit with said open end positioned at a level higher than said cooling-water circuit; and a cooling-water inlet valve provided at said open end of said cooling-water feeding tube, thereby allowing the cooling water fed in said cooling-water feeding tube to run down therethrough by gravity.

6. The Stirling refrigeration system according to claim 2, further comprising:

a cooling-water feeding tube having an open end for feeding cooling water into said cooling-water circuit, said cooling-water feeding tube connected to said cooling-water circuit with said open end positioned at a level higher than said cooling-water circuit; and a cooling-water inlet valve provided at said open end of said cooling-water feeding tube, thereby allowing the cooling water fed in said cooling-water feeding tube to run down therethrough by gravity.

7. The Stirling refrigeration system according to claim 2, wherein, at least a portion of each air extraction tube is transparent or translucent, for convenience of monitoring the amount of air accumulating in said air release duct during operation.

8. The Stirling refrigeration system according to claim 3, wherein, at least a portion of each air extraction tube is transparent or translucent, for convenience of monitoring the amount of air accumulating in said air release duct during operation.

9. The Stirling refrigeration system according to claim 5, wherein, at least a portion of each air extraction tube is transparent or translucent, for convenience of monitoring the amount of air accumulating in said air release duct during operation.

10. A Stirling refrigeration system including one cooling water pump and at least two Stirling refrigeration units, wherein each Stirling refrigeration unit has:

a compression unit for compressing a working gas;

a WGE (Working Gas End) heat exchanger for cooling said working gas that has risen in temperature in said compression unit through heat exchange between said working gas and cooling water;

an expansion unit for cooling the cold head to a low temperature through expansion of said working gas received from said compression unit;

a heat exchanger for effecting heat exchange between said cooled cold head and said working gas; and a radiator for cooling the cooling water that was heated in said WGE heat exchanger by effecting heat exchange between said cooling water and the atmosphere, and wherein each of the radiators is connected to a corresponding one of the WGE heat exchangers by means of a tube to form a radiator WGE heat exchanger assembly, and the assemblies are further connected in series to form a cooling water circuit such that said cooling water, pumped from said one cooling water pump, is circulated through said serially connected radiator-WGE heat exchanger assemblies;

each of the heat exchangers of the respective Stirling refrigeration units is connected in series with a low temperature heat utilization appliance to form a refrigerant circulation circuit for circulating therethrough said refrigerant;

a refrigerant storage tank is connected to said refrigerant circulation circuit, said tank adapted to store an amount of refrigerant necessary to regulate the amount of the refrigerant in circulation through said refrigerant circulation circuit and to store the gaseous refrigerant generated in said refrigerant circulation circuit; and a pressure regulator is connected to an upper section of said tank for regulating the pressure in said tank.

11. A Stirling refrigeration system including one cooling water pump and at least two Stirling refrigeration units, wherein each Stirling refrigeration unit has a compression unit for compressing a working gas;

a WGE (Working Gas End) heat exchanger for cooling said working gas that has risen in temperature in said compression unit through heat exchange between said working gas and cooling water;

an expansion unit for cooling a cold head to a low temperature through expansion of said working gas received from said compression unit;

a heat exchanger for effecting heat exchange between said cooled cold head and a refrigerant; and a radiator for cooling the cooling water that was heated in said WGE heat exchanger by effecting heat exchange between said cooling water and the atmosphere, and wherein each of the heat exchangers of the respective Stirling refrigeration units is connected in series with a low-temperature heat utilization appliance to form a refrigerant circulation circuit for circulating therethrough said refrigerant;

each of the radiators is connected to a corresponding one of the WGE heat exchangers by means of a U-shaped tube to form a radiator-WGE heat exchanger assembly, and the assemblies are further connected in series to form a cooling water circuit such that said cooling water, pumped from said one cooling water pump, is circulated through said serially connected radiator-WGE heat exchanger assemblies.

* * * * *